US011071663B1

(12) United States Patent
Cable et al.

(10) Patent No.: US 11,071,663 B1
(45) Date of Patent: Jul. 27, 2021

(54) HUMAN STABILIZATION PLATFORMS AND RELATED METHODS

(71) Applicant: Cornerstone Research Group, Inc., Miamisburg, OH (US)

(72) Inventors: Kristin M. Cable, Dayton, OH (US); Jason P. Rice, Dayton, OH (US); Mitchell D. Bauer, Dayton, OH (US); Jason M. Hermiller, Lebanon, OH (US); Bryan M. Pelley, Miamisburg, OH (US); Kelly H. Ridout, New Paris, OH (US); Matthew B. Sunday, California, KY (US); Joseph H. Althaus, Yellow Springs, OH (US)

(73) Assignee: Cornerstone Research Group, Inc., Miamisburg, OH (US)

( * ) Notice: Subject to any disclaimer, the term of this patent is extended or adjusted under 35 U.S.C. 154(b) by 6 days.

(21) Appl. No.: 16/735,339

(22) Filed: Jan. 6, 2020

Related U.S. Application Data

(63) Continuation of application No. 15/334,178, filed on Oct. 25, 2016, now Pat. No. 10,583,055.

(60) Provisional application No. 62/246,475, filed on Oct. 26, 2015.

(51) Int. Cl.
*A61G 1/048* (2006.01)
*A61G 1/04* (2006.01)
*A61G 3/00* (2006.01)

(52) U.S. Cl.
CPC ..... *A61G 1/048* (2013.01); *A61G 1/04* (2013.01); *A61G 3/006* (2013.01)

(58) Field of Classification Search
CPC ..... A61G 1/048; A61G 1/04; A61G 3/006; A61G 13/101; A61G 13/105; A61B 2090/571
See application file for complete search history.

(56) References Cited

U.S. PATENT DOCUMENTS 2,387,376 A * 10/1945 Winer ..... A61G 1/048 5/627
3,176,321 A * 4/1965 Shump ..... A61G 1/013 5/627
3,836,270 A * 9/1974 Chambers ..... E04B 1/2604 403/218
4,113,218 A * 9/1978 Linder ..... A61G 13/10 248/124.1

(Continued)

FOREIGN PATENT DOCUMENTS

FR 2789302 A1 * 8/2000 ..... A61G 1/013

*Primary Examiner* — Eric J Kurilla
(74) *Attorney, Agent, or Firm* — TraskBritt

(57) ABSTRACT

Human stabilization platforms may include a support structure configured to rigidly support a person. A rail may extend longitudinally from proximate a portion of the support structure configured to receive the person's head thereon to proximate a portion of the support structure configured to receive the person's lower legs thereon on each lateral side of the support structure. Each rail may include selectable attachment structures distributed along at least a portion of the longitudinal length of the rail. The selectable attachment structures may be configured to receive modular accessories to be secured to the human stabilization platform. The selectable attachment structures may include a channel including alternating enlarged sections and constricted sections.

20 Claims, 10 Drawing Sheets

(56) References Cited

U.S. PATENT DOCUMENTS 5,179,746 A * 1/1993 Rogers ..... A61G 1/04 280/47.29
5,263,213 A * 11/1993 Robertson ..... A61G 1/00 5/601
5,497,968 A * 3/1996 Hewko ..... A61G 1/04 248/214
5,845,351 A * 12/1998 Berta ..... A61G 1/04 5/626
6,023,800 A * 2/2000 Stickley ..... A61G 7/0507 248/229.26
6,446,285 B1 * 9/2002 Chinn ..... A61G 1/04 108/49
6,493,890 B2 * 12/2002 Smeed ..... A61G 1/04 108/49
7,458,743 B2 * 12/2008 Smeed ..... A61G 1/04 403/68
8,739,335 B1 * 6/2014 Hoggatt ..... A61M 5/1417 5/626
10,010,460 B2 * 7/2018 Sirkin ..... A61G 1/04
2002/0104934 A1 * 8/2002 Elliott ..... A61M 5/1415 248/126
2003/0115671 A1 * 6/2003 Smeed ..... A61G 1/04 5/503.1
2007/0124858 A1 * 6/2007 Ahlman ..... A61G 1/00 5/81.1 R
2010/0139005 A1 * 6/2010 Perez ..... F16M 11/42 5/658
2010/0146702 A1 * 6/2010 Sherman ..... A47C 21/00 5/503.1
2012/0066836 A1 * 3/2012 Kaarstein ..... A61G 1/013 5/627
2012/0241571 A1 * 9/2012 Masionis ..... A61G 1/04 248/214
2012/0255565 A1 * 10/2012 Hursh ..... A61G 1/00 128/870
2012/0304390 A1 * 12/2012 Perez ..... F16M 11/42 5/658
2013/0247299 A1 * 9/2013 Schleitzer ..... A61G 13/101 5/600
2013/0269711 A1 * 10/2013 Porter ..... A61G 1/013 128/845
2013/0340170 A1 * 12/2013 Chinn ..... A61G 1/04 5/628
2014/0197654 A1 * 7/2014 Valentino ..... A61G 1/0262 296/20
2014/0238408 A1 * 8/2014 Shepherd ..... A61G 13/101 128/845
2014/0276269 A1 * 9/2014 Illindala ..... A61G 1/04 601/41
2016/0324702 A1 * 11/2016 Smeed ..... F16M 13/02
2017/0246059 A1 * 8/2017 Chinn ..... F16M 13/02
2018/0000666 A1 * 1/2018 Sirkin ..... A61G 1/052
2018/0110662 A1 * 4/2018 Doak ..... F16M 13/022
2018/0289566 A1 * 10/2018 Talati ..... A61G 1/048
2019/0254904 A1 * 8/2019 Schulz ..... A61D 3/00

* cited by examiner

HUMAN STABILIZATION PLATFORMS AND RELATED METHODS

CROSS-REFERENCE TO RELATED APPLICATIONS

This application is a continuation of U.S. patent application Ser. No. 15/334,178, filed Oct. 25, 2016, now U.S. Pat. No. 10,583,055, issued Mar. 10, 2020, which claims the benefit of the filing date of U.S. Provisional Patent App. Ser. No. 62/246,475, filed Oct. 26, 2015, the disclosure of each of which is incorporated herein in its entirety by this reference.

STATEMENT REGARDING FEDERALLY SPONSORED RESEARCH OR DEVELOPMENT

The subject matter of this disclosure was made with U.S. Government support under Contract Numbers W81WH-10-C-0193 and W81XWH-15-C-0050 awarded by U.S. Army Medical Research Acquisition Activity to Cornerstone Research Group Inc. The U.S. Government has certain rights in the claimed invention.

TECHNICAL FIELD

This disclosure relates generally to human stabilization platforms to support and substantially immobilize the spine of a person. More specifically, disclosed embodiments relate to human stabilization platforms that may be easier to carry, may accommodate the selective attachment of modular accessories to enhance the utility of the platform for different applications, and may reduce peak pressure to which a person's body may be exposed while providing support to the person's spine and body.

BACKGROUND

When a person suffers a head or spinal injury, their head and neck may be immobilized to reduce the risk of further injury during transport and treatment. For example, neck braces, backboards, and crown-encircling stabilizers (also known in the art as "halo" devices) may be used to support a person's head and neck to reduce the risk of further injury.

People who experience traumatic injuries in most cases must, of necessity, endure potentially damaging acceleration, impact and vibrational forces experienced during handling and movement by, for example, search and rescue and emergency medical personnel during transport from an injury site to medical facilities with treatment capabilities. This transport may involve both ground transport and flight on rotary and/or fixed-wing aircraft, all of which may expose the injured person to additional, potentially injurious forces, which may exacerbate the severity of the initial injuries. Proper immobilization and shock load isolation may substantially reduce the mortality and comorbidities associated with these injuries while in transit. Equipment currently used for people with a spinal cord injury (SCI) or traumatic brain injury (TBI) may provide some level of immobilization, but leave substantial room for improvement and flexibility to address specific applications.

BRIEF SUMMARY

In some embodiments, human stabilization platforms may include a support structure configured to rigidly support a person. A rail may extend longitudinally from proximate a portion of the support structure configured to receive the person's head thereon to proximate a portion of the support structure configured to receive the person's lower legs thereon on each lateral side of the support structure. Each rail may include selectable attachment structures distributed along at least a portion of the longitudinal length of the rail. The selectable attachment structures may be configured to receive modular accessories to be secured to the human stabilization platform. A handle may be located at each end of each rail, each handle being rotatable with respect to the rail to enable manual handling and transport of the human stabilization platform.

In other embodiments, methods of making human stabilization platforms may involve sizing, shaping, and configuring a support structure configured to substantially and rigidly support a person. A rail may extend longitudinally from proximate a portion of the support structure configured to receive the person's head thereon to proximate a portion of the support structure configured to receive a person's lower legs thereon on each lateral side of the support structure. Each rail may include selectable attachment structures distributed along at least a portion of the longitudinal length of the rail. The selectable attachment structures may be configured to receive modular accessories to be secured to the human stabilization platform. A handle may be positioned at each end of each rail, each handle being rotatable with respect to the rail, each handle being configured to enable manual handling and transport of the human stabilization platform.

In still other embodiments, method of using human stabilization platforms may involve rigidly supporting a person on a support structure. A modular accessory may be secured to a selectable attachment structure, the selectable attachment structure being selected from a set of selectable attachment structures distributed along at least a portion of a longitudinal length of at least one of a pair of rails. Each rail may extend longitudinally from proximate a portion of the support structure on which the person's head is located to proximate a portion of the support structure on which the person's lower legs are located on a respective lateral side of the support structure. At least one handle at an end of at least one rail may be rotated laterally outward from the at least one rail, the at least one handle being one of a set of handles rotatable with respect to, and located at the longitudinal end of, each rail. Each handle may be configured to enable manual handling and transport of the human stabilization platform.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular human stabilization platform or component thereof, but are merely idealized representations employed to describe illustrative embodiments. Thus, the drawings are not necessarily to scale.

Figure 2:
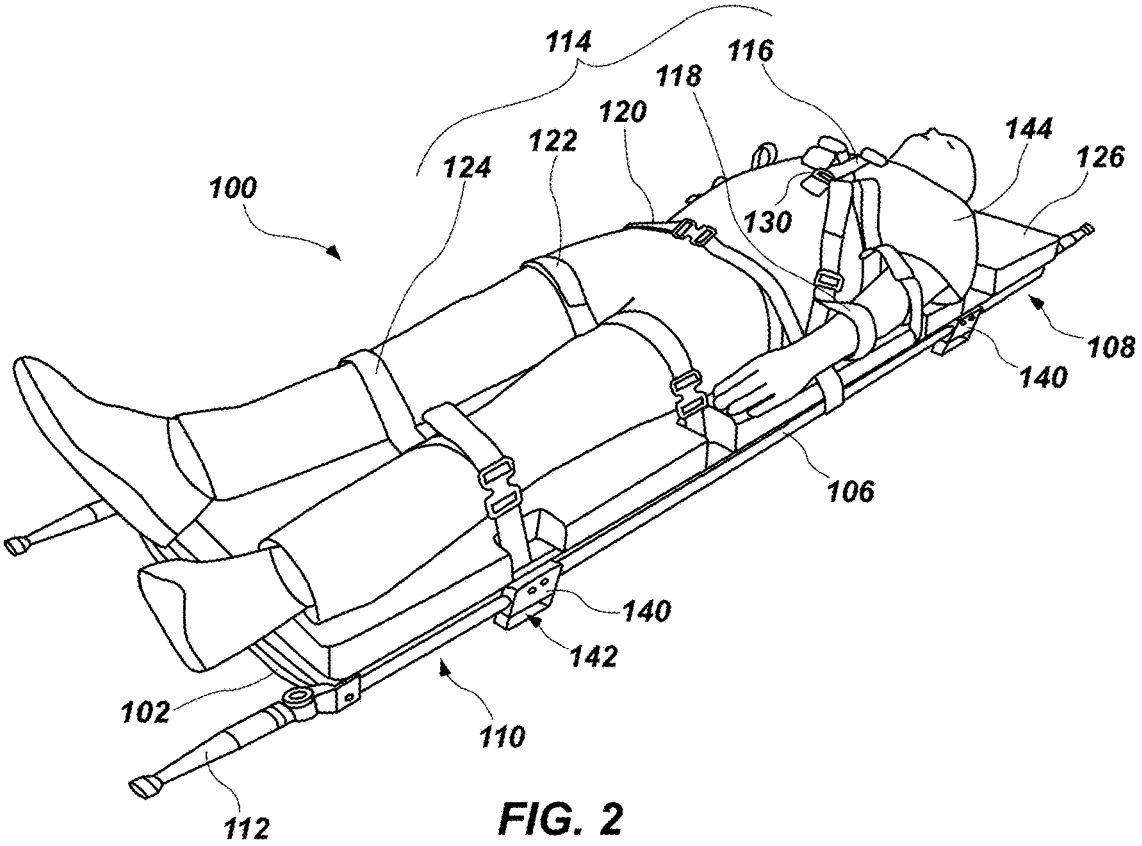
FIG. 2 is a perspective view of the human stabilization platform of FIG. 1 with a person immobilized on the human stabilization platform.

As used in this disclosure, the term "longitudinal" means and includes directions extending at least substantially head-to-toe when a person is secured in a human stabilization platform as shown in FIG. 2. The term "lateral," as used in this disclosure, means and includes directions extending at least substantially shoulder-to-shoulder when a person is secured in a human stabilization platform as shown in FIG. 2.

Existing equipment for immobilizing traumatically injured persons may not be effective to isolate the patient from the dynamic multi-axial shock loading and vibrations present during transport. Treatment efficacy may be further diminished due to the current systems' inability to properly address polytrauma treatment issues, provide clear access to injury sites, manage bodily fluids, reduce the risk of pressure ulcerations, or be applied to an injured person in a variety of positions and orientations. With the increasing prevalence of SCI, TBI, and polytrauma patients due to the expanded use of improvised explosive devices (IEDs) on military forces, a renewed transport platform design may improve the specific transport, safety, care, and comfort needs of both the injured and caregivers.

Disclosed embodiments relate generally to human stabilization platforms that may be easier to carry, may accommodate the selective attachment of modular accessories to enhance the utility of the platform for different applications, and may reduce peak pressure to which a person's body may be exposed while providing support to the person's spine and body.

Figure 1:
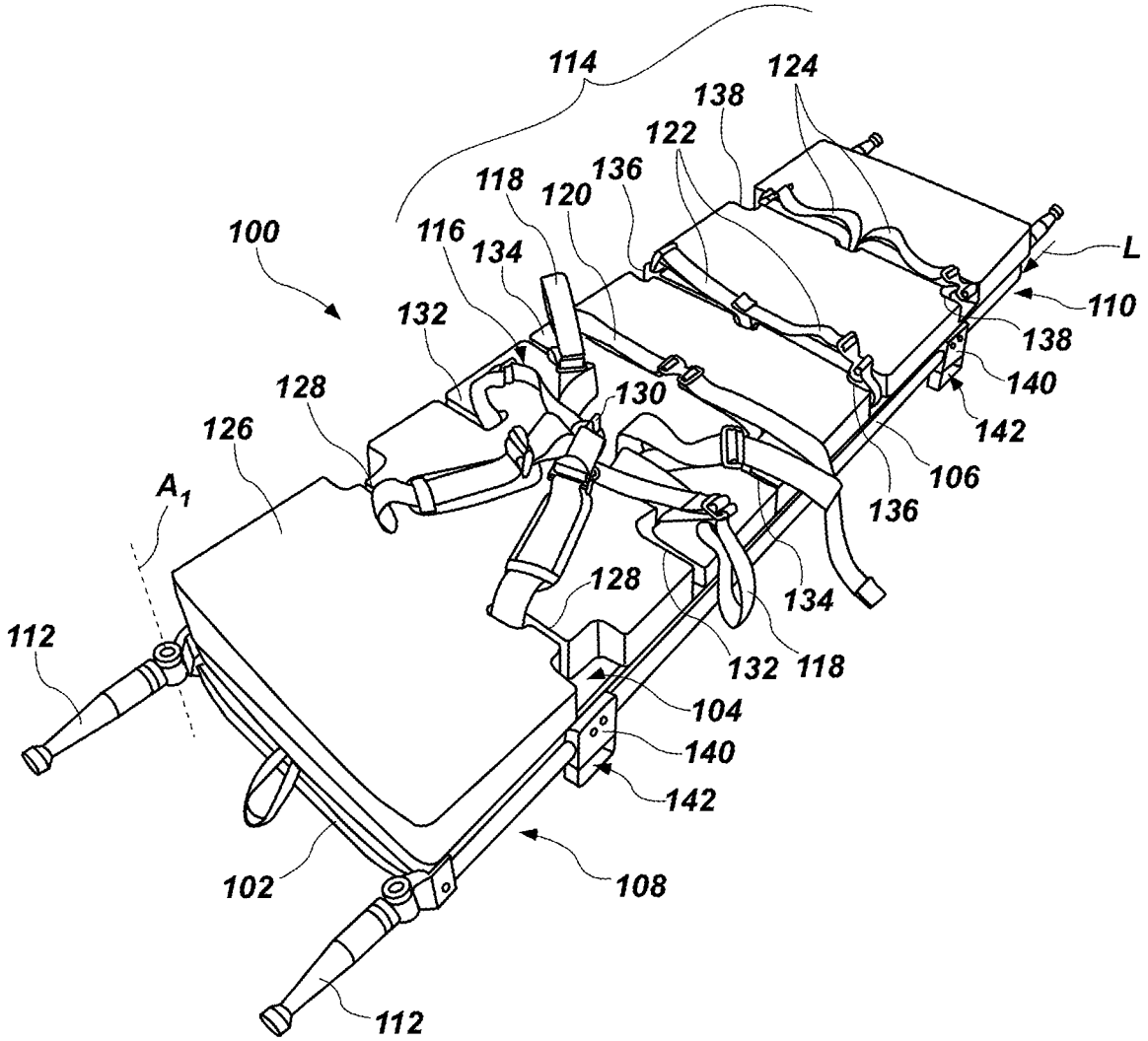
FIG. 1 is a perspective view of a human stabilization platform.

Referring to FIG. 1, a perspective view of a human stabilization platform 100 is shown. The human stabilization platform 100 may include, for example, a support structure 102 configured to rigidly support a person thereon. The support structure 102 may include, for example, an upper surface 104 (e.g., a major plane) positioned to face a person when the person is supported on the support structure. The upper surface 104 may exhibit, for example, an at least substantially rectangular shape.

The support structure 102 may be a rigid structure configured to at least substantially retain its shape to maintain alignment of the person's spine and reduce the likelihood of further injuring the person when subjected to the accelerations, forces, and vibrations of transport. For example, the support structure 102 may include a composite material. More specifically, the support structure 102 may include a honeycomb core and a surrounding fiber-matrix composite material. As a specific, nonlimiting example, the support structure 102 may include a honeycomb core and a combination of unidirectional and fabric plies (e.g., between about 30% and about 50%, such as 40%, unidirectional and between about 50% and about 70%, such as 60%, fabric) of carbon-fiber, epoxy-matrix composite material. Such materials may reduce the weight of the support structure 102 while maintaining or increasing its rigidity and strength in comparison to conventional support structures, while also dampening potentially harmful vibrations.

A rail 106 may extend longitudinally from proximate a portion 108 of the support structure 102 configured to receive the person's head thereon to proximate a portion 110 of the support structure 102 configured to receive a person's lower legs thereon on each lateral side of the support structure 102. Each rail 106 may include, for example, a rigid beam extending along the lateral side of the support structure 102, and may include a channel 182 (see FIG. 11) extending along at least a portion of the longitudinal length of the respective rail. Each rail 106 may include selectable attachment structures 180 (see FIGS. 11, 12) distributed along at least a portion of the longitudinal length L of the respective rail. For example, the selectable attachment structures 180 (see FIGS. 11, 12) may be distributed along at least 50% of the longitudinal length L of each rail 106. More specifically, the selectable attachment structures 180 (see FIGS. 11, 12) may be distributed along at least 75% (e.g., at least 90%) of the longitudinal length L of each rail 106. The selectable attachment structures 180 (see FIGS. 11, 12) may be located, for example, within the channel 182 (see FIG. 11). More specifically, the selectable attachment structures 180 (see FIGS. 11, 12) may be distributed along one or more surfaces of the rail 106 at least partially defining the channel 182 (see FIG. 11) (e.g., a surface extending at least substantially parallel, perpendicular, or at an oblique angle with respect to the upper surface 104 of the support structure 102).

A handle 112 may be located at each end of each rail 106. Each handle 112 may be rotatable with respect to the rail 106 to facilitate easier handling by another person to carry the human stabilization platform 100 and to facilitate storage of the handles 112. For example, an axis of rotation $A_1$ about which each respective handle 112 is configured to rotate may extend in a direction at least substantially perpendicular to the major plane of the upper surface 104 of the support structure 102 to enable the handles 112 to pivot laterally outwardly for rescue and emergency medical personnel to carry the human stabilization platform or inwardly for stowage.

The human stabilization platform 100 may include a patient-securing system 114 configured to secure a person's body to the human stabilization platform 100. The patient-securing system 114 may include, for example, a five-point harness 116, a pair of wrist-restraint straps 118, an adjustable pelvic-restraint strap 120, a pair of thigh-restraint straps 122, and a pair of ankle-restraint straps 124 secured to the support structure 102 and positioned to secure a person to the human stabilization platform 100. Each of the foregoing straps 118, 120, 122, and 124 may be adjustable longitudinally along the human stabilization platform 100, and may be stowable (e.g., between a mattress 126 supported on the upper surface 104 of the support structure 102 and the support structure 102 or below the support structure 102) to enable selective use and nonuse of any given strap 118, 120, 122, and 124, which may accommodate patients of a wider variety of body sizes and shapes and may enable a patient to be secured to the human stabilization platform 100 while reducing (e.g., eliminating) contact between straps 118, 120, 122, and 124 and injury sites.

A mattress 126 may be supported on, and in some embodiments secured to, the upper surface 104 of the support structure 102 and the support structure 102. A material of the mattress 126 may be configured to distribute pressure across a greater area of a person's body, reducing peak pressure and reducing the risk of pressure ulcers. The mattress 126 may include, for example, slots, slits, grooves, channels, holes, or other passages therethrough to enable straps 118, 120, 122, and 124 of the patient-securing system 114 to extend from below the mattress 126 proximate the support structure 102, through the mattress 126 via the passages, to above the mattress 126 on a side of the mattress 126 opposite the support structure 102. For example, the mattress 126 may include at least two shoulder slots 128, each shoulder slot 128 extending from a lateral periphery of the mattress 126 to a location above where a person's shoulders are configured to be received on the mattress 126 and laterally spaced from a location where the person's neck is configured to be received to enable straps of the five-point harness 116 to extend from the shoulder slots 128, over the person's shoulders, to a buckle 130.

In addition, the mattress 126 may include at least two torso slots 132, each torso slot 132 extending from a lateral periphery of the mattress 126 to a location below where a person's arm pit is configured to be received and laterally adjacent to where the person's torso is configured to be received to enable straps of the five-point harness 116 to extend from the torso slot 132, over the person's torso, to the buckle 130. Each torso slot 132 may further enable additional straps to extend from the torso slot 132, around an upper portion of the person's arm, to proximate the support structure 102. In some embodiments, each torso slot 132 may extend longitudinally downward, upward, or both downward and upward after extending laterally inward (e.g., in an "L" or "T" shape) to enable the straps of the harness 116 extending therethrough to bear laterally against the mattress 126.

The mattress 126 may further include at least two waist slots 134, each waist slot 134 extending from a lateral periphery of the mattress 126 to a location laterally adjacent to where a person's waist is configured to be received to enable straps of the five-point harness 116 to extend from the waist slot 134, over the person's torso, to the buckle 130. Each waist slot 134 may further enable additional wrist-restraint straps 118 to extend from the waist slot 134, around a lower portion of the person's arm, to proximate the support structure 102. Each waist slot 134 may further enable additional pelvic-restraint straps 120 to extend from the waist slot 134, over the person's pelvis, the straps 120 being securable to one another between the person's thighs. In some embodiments, each waist slot 134 may extend longitudinally downward, upward, or both downward and upward after extending laterally inward (e.g., in an "L" or "T" shape) to enable the straps 118 and 120 and those of the harness 116 extending therethrough to bear laterally against the mattress 126.

The mattress 126 may also include at least two thigh slots 136, each thigh slot 136 extending from a lateral periphery of the mattress 126 to a location laterally adjacent to where a person's thigh is configured to be received to enable each thigh-restraint strap 122 to extend from the thigh slot 136, around the person's thigh, to the other strap 122 extending from the other thigh slot 136, the straps 122 being securable to one another between the person's thighs. In some embodiments, each thigh slot 136 may extend longitudinally downward, upward, or both downward and upward after extending laterally inward (e.g., in an "L" or "T" shape) to enable the straps 122 extending therethrough to bear laterally against the mattress 126.

Finally, the mattress 126 may include at least two shin slots 138, each shin slot 138 extending from a lateral periphery of the mattress 126 to a location laterally adjacent to where a person's shin is configured to be received to enable each ankle-restraint strap 124 to extend from the shin slot 138, around the person's shin, to the other strap 124 extending from the other shin slot 138, the straps 124 being securable to one another between the person's shins. In some embodiments, each shin slot 138 may extend longitudinally downward, upward, or both downward and upward after extending laterally inward (e.g., in an "L" or "T" shape) to enable the straps 124 extending therethrough to bear laterally against the mattress 126.

Vibration-damping feet 140 may extend downwardly from the support structure 102. Each vibration-damping foot 140 may include an elastomeric damping material configured to dampen potentially harmful vibrations. Each vibration-damping foot 140 may also comprise a slot 142 extending therethrough to facilitate attachment of the human stabilization platform to a securing structure. The slot 142 may extend through a strong material (e.g., aluminum or steel) of the foot 140, which material may be secured to the elastomeric damping material. The vibration-damping feet 140 may be selectively attachable to, and detachable from, the selectable attachment structures 180 (see FIGS. 11, 12) in some embodiments. In other embodiments, the vibration-damping feet 140 may be permanently attached to the rails 106 or support structure 102. The vibration-damping feet 140 may reduce potentially harmful vibrations emanating from a vehicle or other device on which the vibration-damping feet 140 may rest or be secured to during transport.

A total weight of the human stabilization platform 100 may be, for example, about 60 lbs or less, which may enable it to be relatively easily transported, even when supporting a person and medical equipment thereon or therefrom. More specifically, the total weight of the human stabilization platform may be, for example, about 55 lbs or less. As a specific, nonlimiting example, the total weight of the human stabilization platform may be about 50 lbs or less.

FIG. 2 is a perspective view of the human stabilization platform 100 of FIG. 1 with a person 144 immobilized on the human stabilization platform 100. When securing the person 144 to the human stabilization platform 100, the person 144 may be lifted onto the mattress 126, or the human stabilization platform 100, including the mattress 126 may be slid underneath the person 144. The person's head may be supported on a first portion 108 of the mattress 126 at a first longitudinal end thereof, and the person's feet may be supported on a second portion 110 of the mattress 126 at a second, opposite longitudinal end thereof.

The person 144 may then be immobilized and secured to the mattress 126 and underlying support structure 102 utilizing one or more of the harness 116 and straps 118, 120, 122, and 124. For example, the straps of the harness 116 may be brought over the person's shoulders and around the person's torso and secured to the buckle 130. Straps extending through the shoulder and torso slots 128 and 132 may also be brought over the person's upper and lower arms and secured to the straps of the harness 116 or to the support structure 102 to secure the arms in place. The pelvic-restraint straps 120 may be positioned over the person's pelvis and secured to one another. Each thigh-restraint strap 122 may be positioned over a respective one of the person's thighs and secured to the other thigh-restraint strap 122, to the support structure 102, or both to restrain the person's upper legs. Each ankle-restraint strap 124 may be positioned over a respective one of the person's shins or ankles and secured to the other ankle-restraint strap 122, to the support structure 102, or both to restrain the person's lower legs. One or more of the straps 118, 120, 122, and 124, one or more portions of the harness 116, or any combination of these may be used or not used during immobilization, depending on the person's body and injury state.

Figure 3:
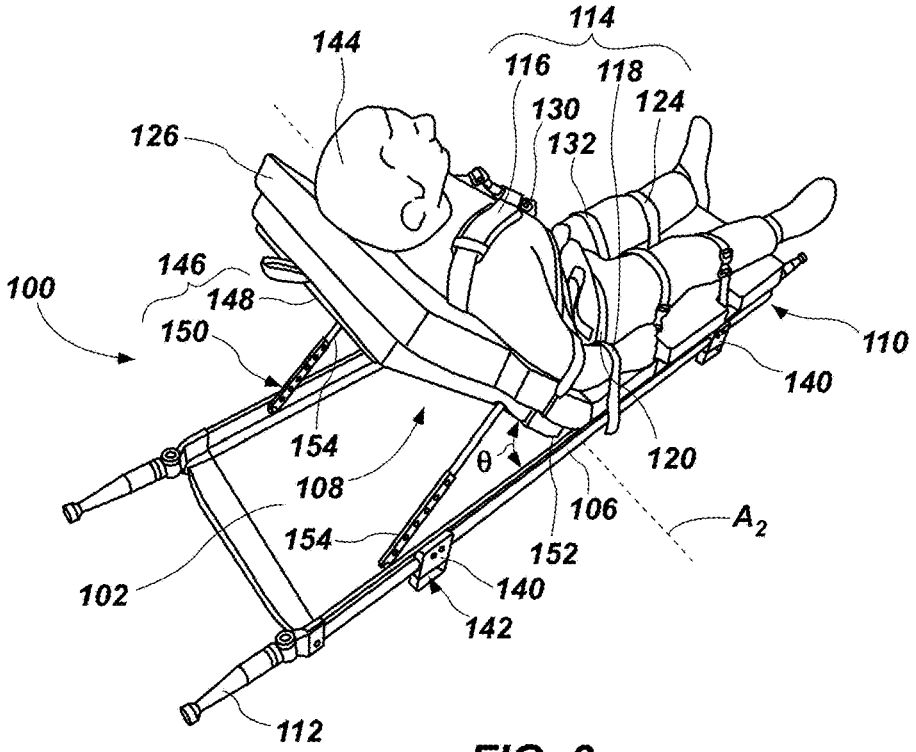
FIG. 3 is a perspective view of the human stabilization platform of FIG. 1 with a person immobilized on the human stabilization platform and a gatch of the human stabilization platform in an elevated state.

FIG. 3 is a perspective view of the human stabilization platform 100 of FIG. 1 with a person 144 immobilized on the human stabilization platform 100. In some embodiments, the human stabilization platform 100 may include a gatch 146 located to receive a person's head and back thereon. The gatch 146 may include a rotatably liftable backrest 148 and an adjustable lifting mechanism 150. The backrest 148 may be further secured to the support structure 102 by a hinge 152 located at an end of the backrest 148 positioned to be located proximate a person's waist when the person 144 is supported on the support structure 102. The adjustable lifting mechanism 150 may secure the backrest 148 to the support structure 102, and may be selectably extendable and securable in position to enable the backrest 148 to rotate about an axis $A_2$ parallel to the major plane of the upper surface 104 of the support structure 102 and perpendicular to the rails 106 of the support structure 102, and to be secured in place to stabilize a person's torso at a desired acute angle θ to the major plane of the upper surface 104 of the support structure 102. The adjustable lifting mechanism 150 may include, for example, a telescoping member 154 on each lateral side of the support structure 102 having one end secured to, and rotatable with respect to, the backrest 148 (e.g., proximate the middle of a longitudinal extent thereof) and another, opposite end secured, and rotatable with respect, to the support structure 102 or a respective rail 106. The telescoping members 154 may be securable at any of a variety of selected lengths to enable the backrest 148 to be secured in position at various angles θ relative to the support structure 102.

Figure 4:
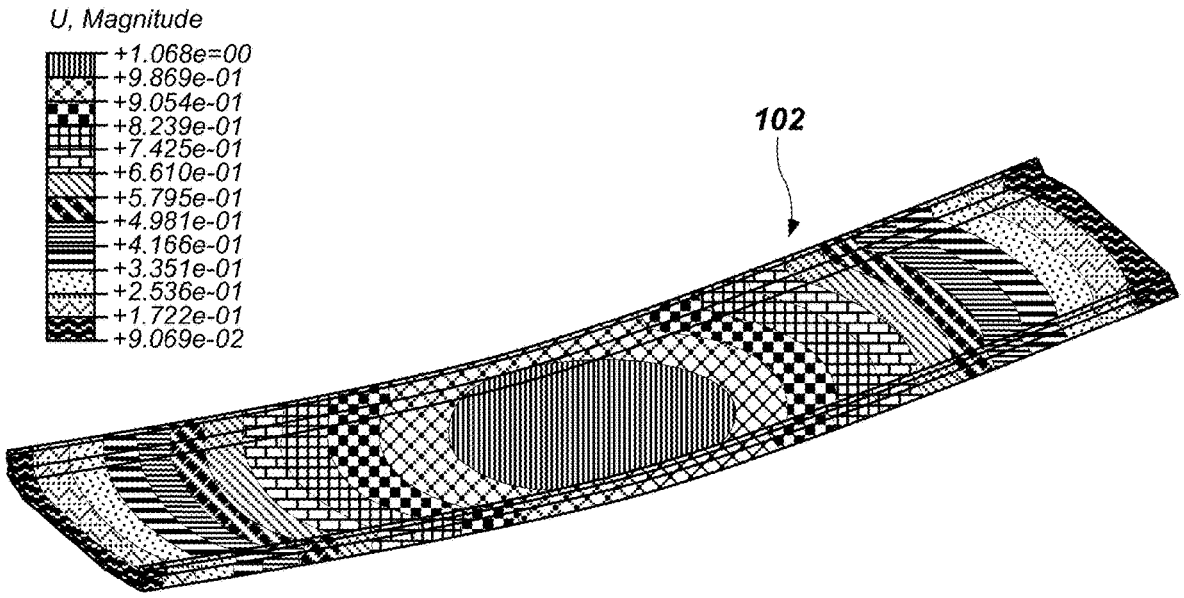
FIG. 4 is a simplified perspective view of a deflection of a support structure of the human stabilization platform of FIG. 1 in response to a predetermined acceleration.

FIG. 4 is a simplified perspective view of a deflection of the support structure 102 of the human stabilization platform 100 of FIG. 1 in response to a predetermined acceleration. The support structure 102 may be sized, shaped, and of a sufficient rigidity to support a $95^{th}$ percentile male person (e.g., a person weighing up to about 250 lbs) and a substantial load (e.g., at least about 75 lbs, such as about 100 lbs or more) of medical equipment through 8 g of downward or lateral accelerations and 12 g of forward accelerations. A maximum deflection of the support structure 102 in response to 8 g of downward acceleration when resting on the feet 140 (see FIGS. 1-3) may be, for example, about 2 inches or less. More specifically, the maximum deflection of the support structure 102 when subjected to 8 g of downward acceleration may be, for example, between about 0.5 inch and about 1.5 inch. As a specific, nonlimiting example, the maximum deflection of the support structure 102 when subjected to 8 g of downward acceleration may be between about 1 inch and about 1.25 inch (e.g., about 1.1 inch).

Figure 5:
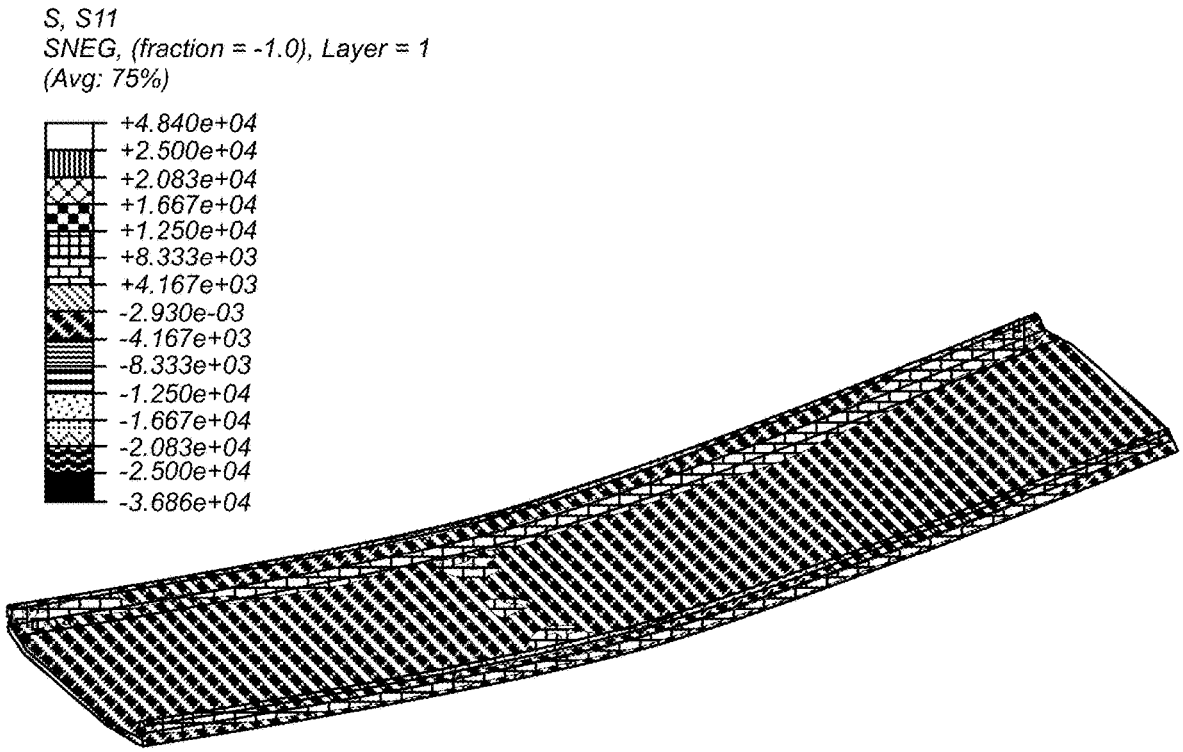
FIG. 5 is a simplified perspective view of a magnitude of stress in the support structure of FIG. 4 in response to the predetermined acceleration.

FIG. 5 is a simplified perspective view of a magnitude of stress in the support structure 102 of FIG. 4 in response to the predetermined acceleration. A maximum longitudinal stress experienced by the support structure 102 in response to 8 g of downward acceleration when resting on the feet 140 (see FIGS. 1-3) may be, for example, about 60 ksi or less. More specifically, the maximum longitudinal stress of the support structure 102 when subjected to 8 g of downward acceleration may be, for example, between about 30 ksi and about 50 ksi. As a specific, nonlimiting example, the maximum longitudinal stress within the support structure 102 when subjected to 8 g of downward acceleration may be between about 40 ksi and about 50 ksi (e.g., about 48 ksi).

Figure 6:
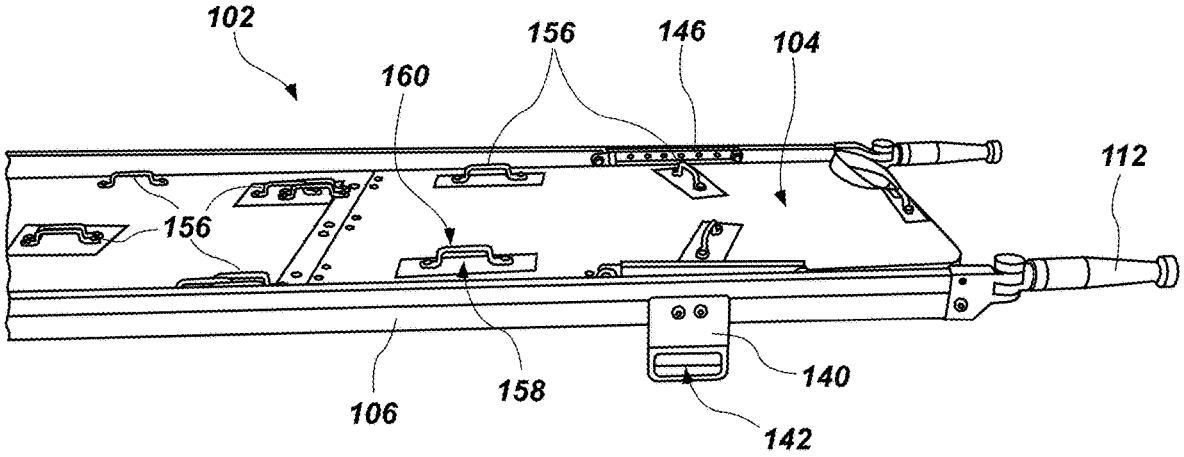
FIG. 6 is a perspective side view of a portion of the support structure of the human stabilization platform of FIG. 1.

FIG. 6 is a perspective side view of a portion of the support structure 102 of the human stabilization platform 100 of FIG. 1. The support structure 102 may include attachment structures 156 configured to secure the mattress 126, harness 116, and straps 118, 120, 122, and 124 (see FIGS. 1-3) to the support structure 102. The attachment structures 156 may be located on the upper surface 104 of the support structure 102 and may include an opening 158 through which portions of the mattress 126, harness 116, and straps 118, 120, 122, and 124 (see FIGS. 1-3) may extend and a fixed arm 160 extending over the opening 158 to retain the portions of the mattress 126, harness 116, and straps 118, 120, 122, and 124 (see FIGS. 1-3) secured to the support structure 102. The attachment structures 156 may be distributed along the longitudinal length and lateral width of the support structure 102 wherever it is desired to affix the mattress 126, harness 116, straps 118, 120, 122, and 124 (see FIGS. 1-3), and any other structures to the support structure 102.

Figure 7:
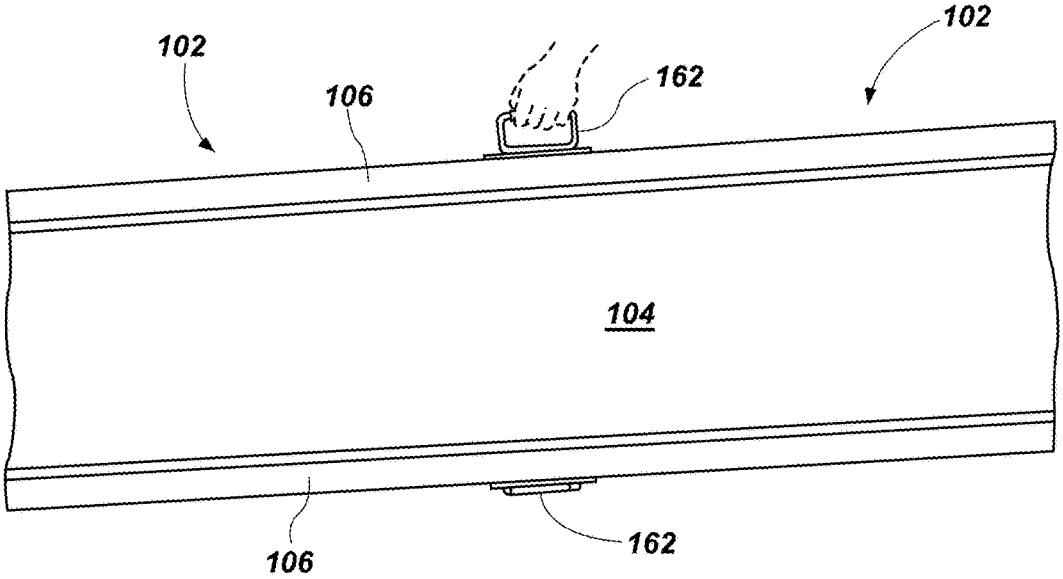
FIG. 7 is a side view of the support structure of FIG. 6 when oriented for one-handed transport by a person.

FIG. 7 is a side view of the support structure 102 of FIG. 6 when oriented for one-handed transport by a person. The support structure 102 may include transport handles 162 located proximate the lateral periphery of the support structure 102. For example, the transport handles 162 may be permanently attached to the support structure 102 or may be removably connected to the selectable attachment structures 180 (see FIGS. 11, 12) of the rails 106. The transport handles 162 may be rotatable with respect to the rails 106 to enable compact storage.

Figure 8:
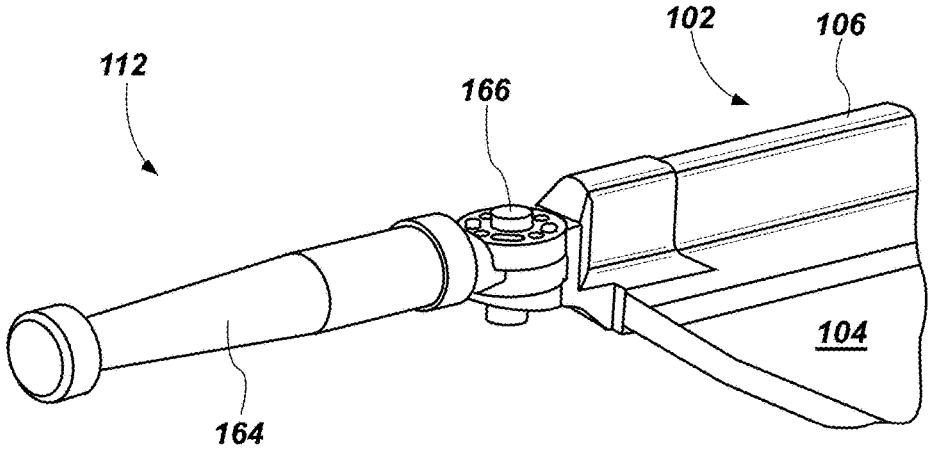
FIG. 8 is an enlarged perspective view of a handle of the support structure of the human stabilization platform of FIG. 1.

FIG. 8 is an enlarged perspective view of a handle 112 of the support structure 102 of the human stabilization platform 100 of FIG. 1. The handle 112 may include a grip 164 sized and shaped to be grasped by a person's hand and a hinge 166 between the grip 164 and the support structure 102, enabling the grip 164 to rotate with respect to the support structure 102. The grip 164 may include, for example, a thermoplastic material. The hinge 166 may be of sufficient strength to bear the loads of transporting a fully-loaded human stabilization platform 100 (see FIGS. 2, 3), including a person and any equipment supported thereby. For example, the hinge 166 may include a high-strength, hardened steel material, and may be secured to the support structure 102 utilizing, for example, rivets, bolts, screws, adhesive, or any combination of these.

Figure 9:
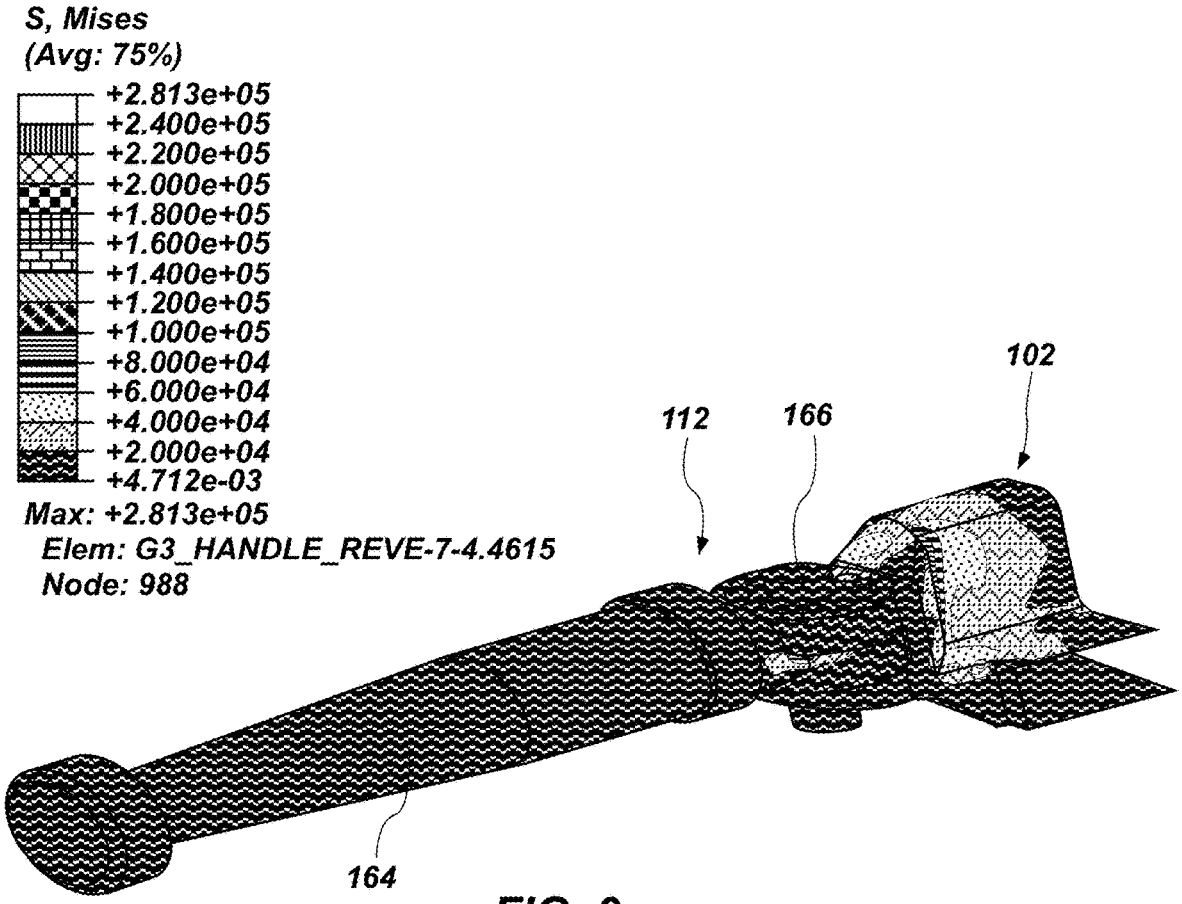
FIG. 9 is a simplified perspective view of a magnitude of stress in the handle of FIG. 8 in response to a predetermined load.

FIG. 9 is a simplified perspective view of a magnitude of stress in the handle 112 of FIG. 8 in response to a predetermined load. For example, a maximum stress within the handle 112, including the location of attachment between the hinge 166 and the support structure 102, when subjected to a downward acceleration of 8 g may be about 60 ksi or less. More specifically, the maximum stress within the handle 112 when subjected to a downward acceleration of 8 g may be between about 20 ksi and about 60 ksi. As a specific, nonlimiting example, the maximum stress within the handle 112 when subjected to a downward acceleration of 8 g may be between about 40 ksi and about 60 ksi (e.g., about 40 ksi).

Figure 10:
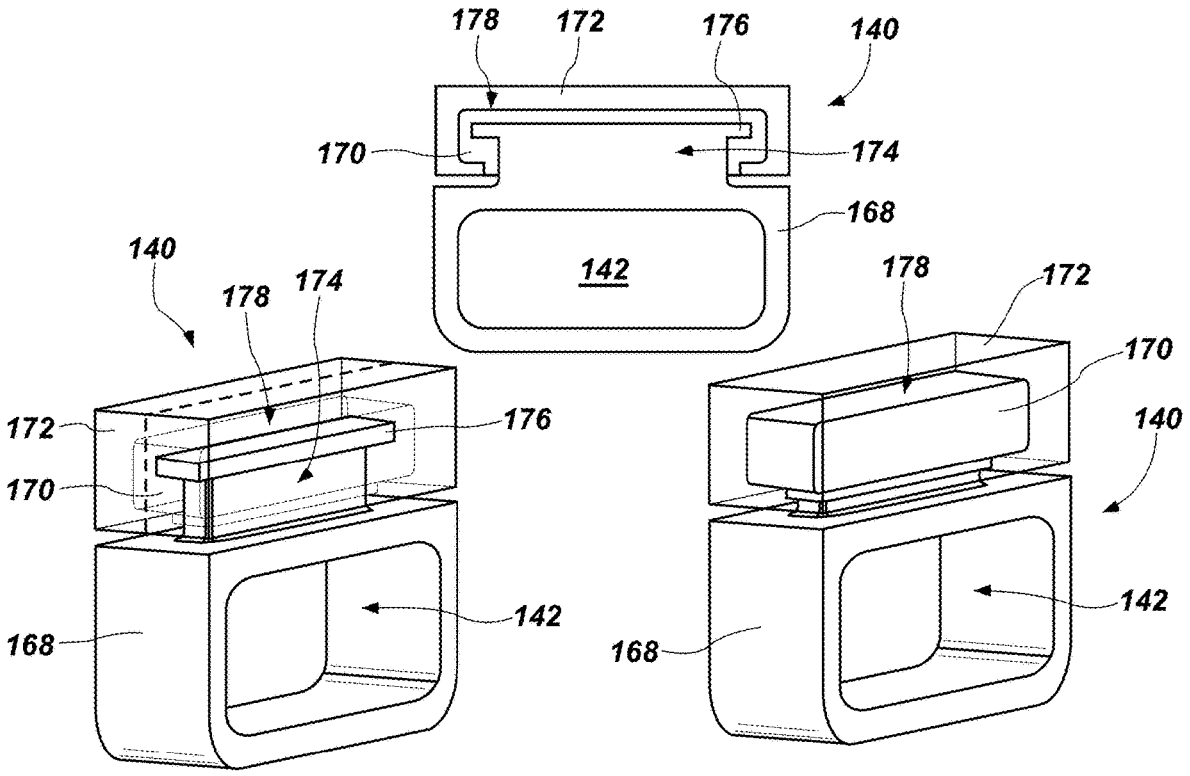
FIG. 10 includes perspective and cross-sectional views of the foot of the support structure of the human stabilization platform of FIG. 1.

FIG. 10 includes perspective and cross-sectional views of a foot 140 of the support structure 102 of the human stabilization platform 100 of FIG. 1. The foot 140 may include a surface-engaging portion 168, a vibration-damping portion 170, and an attachment portion 172. The surface-engaging portion 168 may be positioned to rest on a supporting surface, such as a floor, and may include the slot 142 extending laterally through the surface-engaging portion 168. The slot 142 may be sized and shaped to enable securing structures to extend through the slot 142 to affix the human stabilization platform 100 (see FIGS. 1-3) to the underlying surface. The surface-engaging portion 168 may include a strong material (e.g., aluminum or steel).

The surface-engaging portion 168 may include a protrusion 174 extending up, away from the slot 142. The protrusion 174 may include a laterally, longitudinally, or laterally and longitudinally extending ledge 176. The vibration-damping portion 170 may encapsulate at least a portion of the protrusion 174, including the ledge 176. The vibration-damping portion 170 may include an elastomeric damping material configured to dampen potentially harmful vibrations, reducing the extent to which the vibrations are transferred from a vehicle or other device on which the vibration-damping feet 140 may rest or be secured to during transport through the feet 140 to the support structure 102 (see FIGS. 1-3).

The vibration-damping portion 170 and protrusion 174 may be at least partially located within a cavity 178 within the attachment portion 172 to secure the attachment portion 172 to the surface-engaging portion 168 via the vibration damping portion 170. When forming the foot 140, the protrusion 174 may be positioned at least partially within the cavity 178 and the vibration-damping portion 170 may be formed around at least a portion of the protrusion 174 including the ledge 176 within the cavity 178 (e.g., by injection molding).

Figure 11:
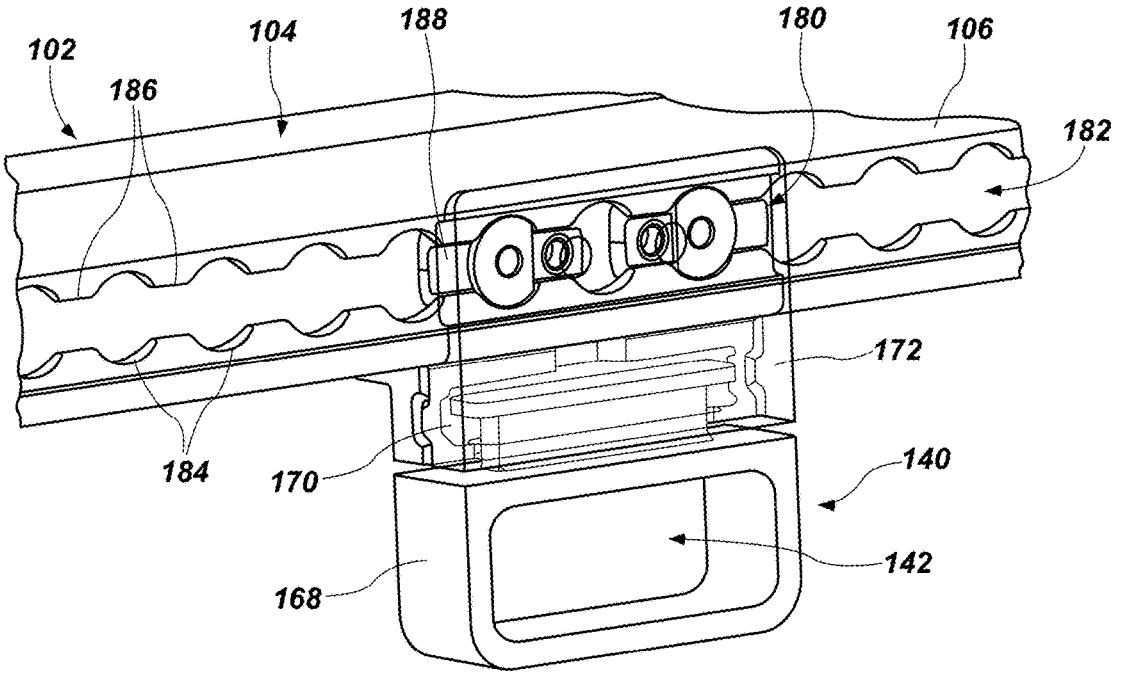
FIG. 11 is an enlarged perspective view of a selectable attachment structure between the foot of FIG. 10 and the support structure of the human stabilization platform of FIG. 1.

FIG. 11 is an enlarged perspective view of a selectable attachment structure 180 between the foot 140 of FIG. 10 and the support structure 102 of the human stabilization platform 100 of FIG. 1. Each rail 106 of the support structure 102 may include selectable attachment structures 180 distributed along at least a portion of the longitudinal length of the respective rail 106. The selectable attachment structures 180 may include, for example, a channel 182 having alternating enlarged sections 184 and constricted sections 186. The attachment portion 172 of each foot 140 may include corresponding protrusions 188 sized and shaped to be inserted into the channel 182 when aligned with the enlarged sections 184 and to be retained within the channel 182 when aligned with the constricted sections 186. For example, each protrusion 188 may include an enlarged head 190 sized and shaped to pass through the enlarged sections 184, but not to pass through the constricted sections 186. In some embodiments, the protrusions may include pins, hooks, loops, clamps, or threaded members configured to mate with corresponding holes, loops, hooks, ledges, or threaded holes within the channel 182 to secure the feet 140 in place.

Figure 12:
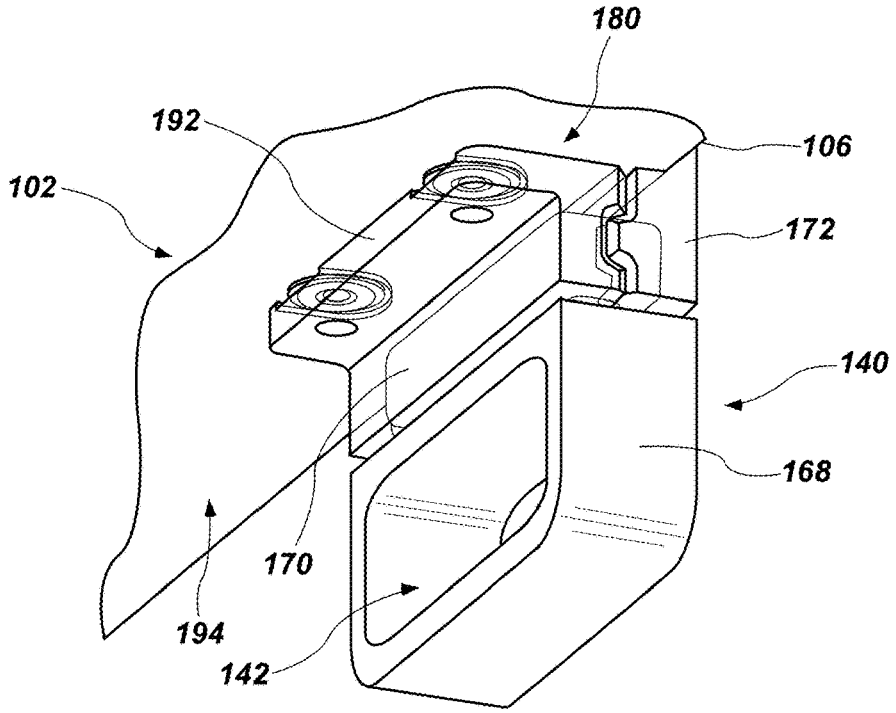
FIG. 12 is a bottom perspective view of the selectable attachment structure of FIG. 11.

FIG. 12 is a bottom perspective view of the selectable attachment structure 180 of FIG. 11. In some embodiments, the attachment portion 172 of each foot 140 may include a lateral extension 192 for positioning proximate a lower surface 194 of the support structure 102 or of a rail 106 thereof. The lateral extension 192 may include pins, holes, hooks, loops, clamps, or threaded members configured to mate with corresponding holes, pins, loops, hooks, ledges, or threaded holes on the lower surface 194 to secure the feet 140 in place.

Figure 13:
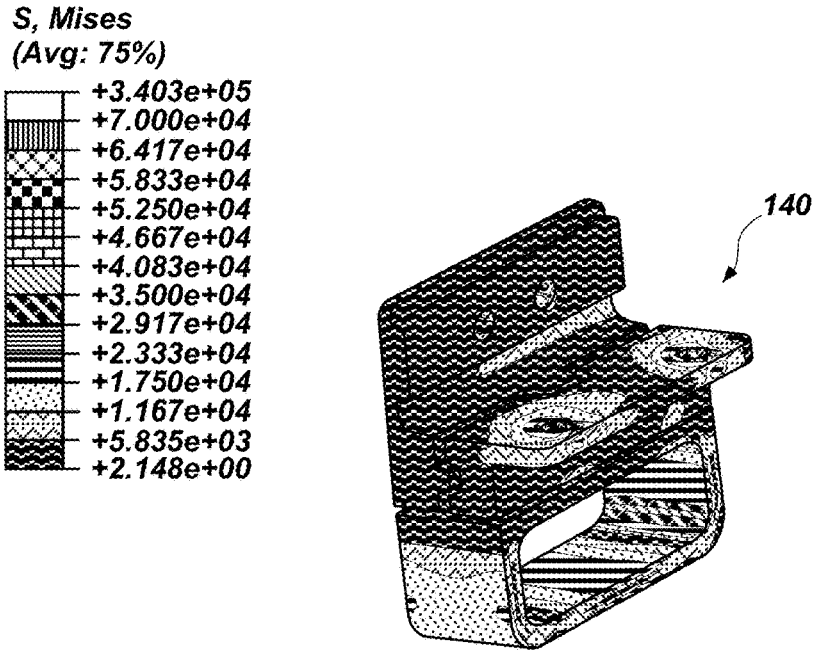
FIG. 13 is an enlarged perspective view of a magnitude of stress in feet of the support structure of the human stabilization platform of FIG. 1 in response to a predetermined load.

FIG. 13 is an enlarged perspective view of a magnitude of stress in feet 140 of the support structure 102 of the human stabilization platform 100 of FIG. 1 in response to a predetermined load. For example, a maximum stress within the feet 140, including the selectable attachment structure 180 (see FIGS. 11, 12), when subjected to a downward acceleration of 8 g may be about 40 ksi or less. More specifically, the maximum stress within the feet 140 when subjected to a downward acceleration of 8 g may be between about 17.5 ksi and about 40 ksi. As a specific, nonlimiting example, the maximum stress within the feet 140 when subjected to a downward acceleration of 8 g may be between about 30 ksi and about 25 ksi (e.g., about 35 ksi).

Figure 14:
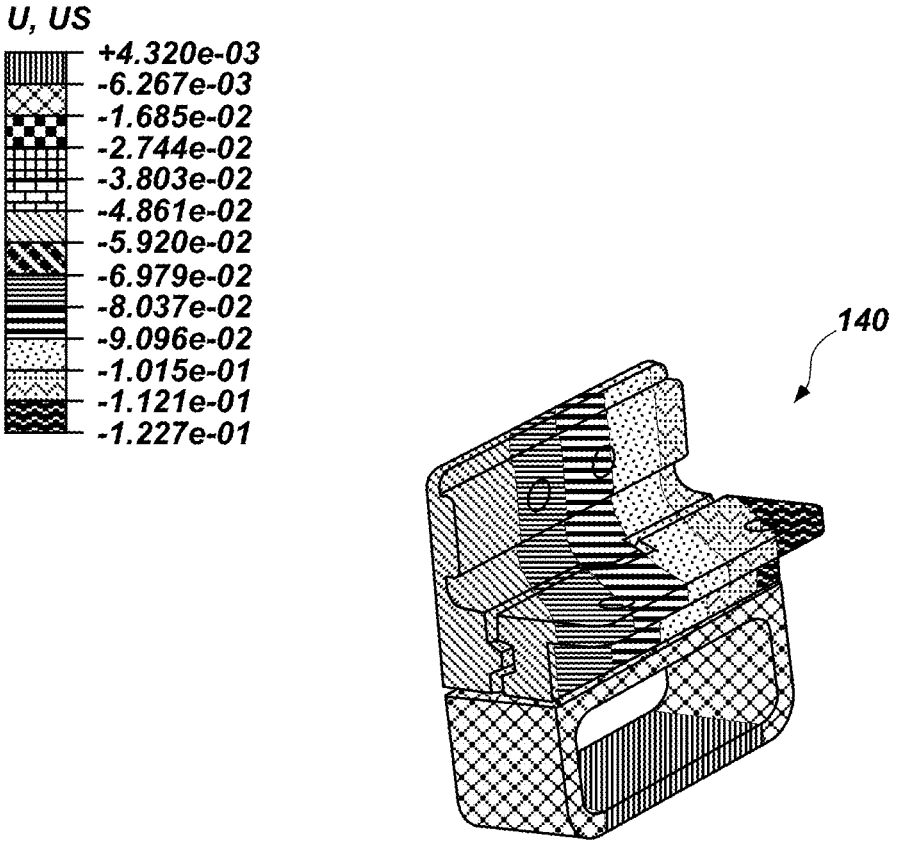
FIG. 14 is an enlarged perspective view of a magnitude of damping in the feet of FIG. 10.

FIG. 14 is an enlarged perspective view of a magnitude of damping in the feet 140 of FIG. 10. For example, a minimum reduction in deflection from the vibration-damping portion 170 of the feet 140 when subjected to a downward acceleration of 8 g may be about 0.1 inch or more. More specifically, the minimum reduction in deflection from the vibration-damping portion 170 of the feet 140 when subjected to a downward acceleration of 8 g may be between about 0.1 inch and about 0.15 inch. As a specific, nonlimiting example, the minimum reduction in deflection from the vibration-damping portion 170 of the feet 140 when subjected to a downward acceleration of 8 g may be between about 0.1 inch and about 0.125 inch (e.g., about 0.12 inch).

Figure 15:
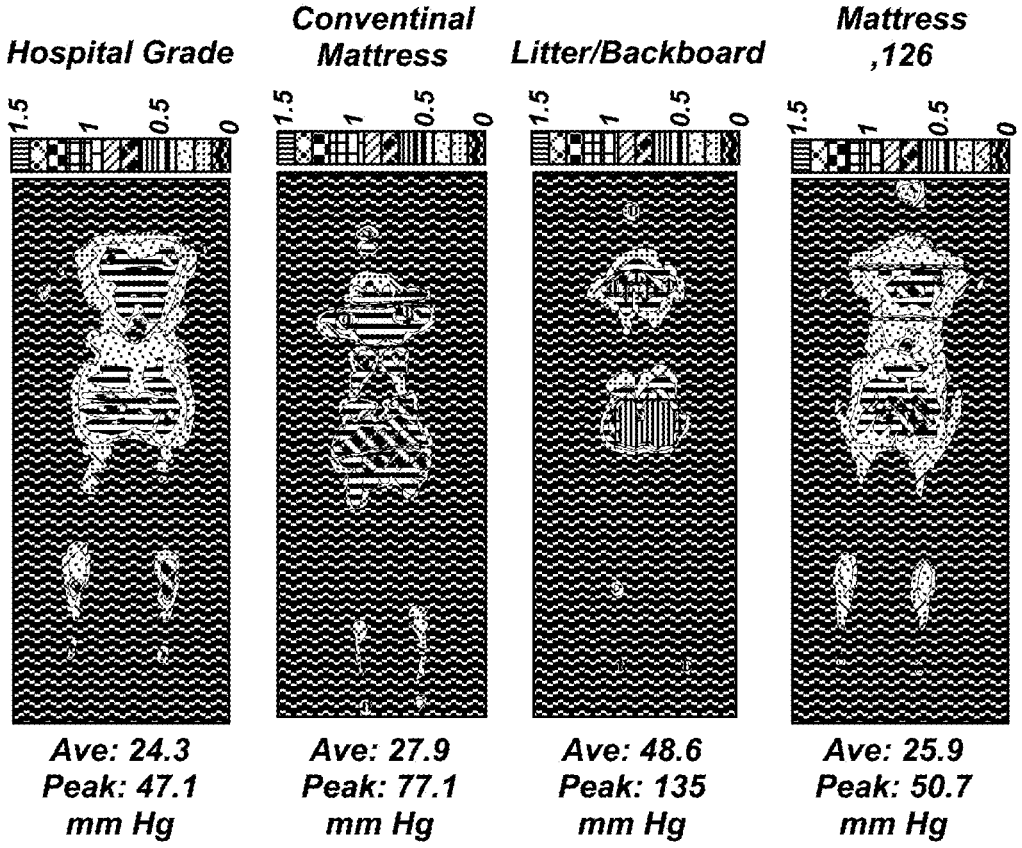
FIG. 15 includes pressure maps for various peak pressures experienced by a person on various stabilization structures.

FIG. 15 includes pressure maps for various peak pressures experienced by a person on mattresses of various stabilization structures. Mattresses 126 in accordance with this disclosure may include, for example, a material configured to maintain peak pressure on a person's body at about 65 mm Hg or less. More specifically, the material of the mattress may maintain peak pressure on the person's body at, for example, about 60 mm Hg or less. As specific, nonlimiting examples, the material of the mattress may maintain peak pressure on the person's body at about 55 mm Hg or less or about 50 mm Hg or less. Such pressure distribution may be comparable to a hospital-grade mattress, which may be considered the gold standard in the field and may represent a significant reduction in peak pressure and a significant increase in pressure distribution when compared to conventional mattresses for human stabilization platforms and backboards.

Figure 16:
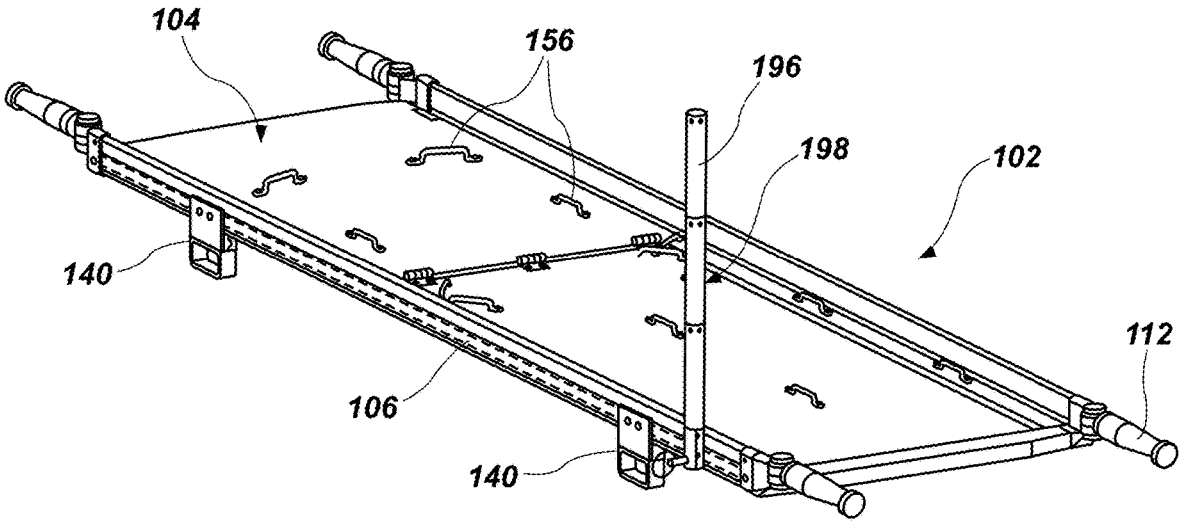
FIG. 16 is a perspective view of the support structure of the human stabilization platform of FIG. 1 with a modular attachment secured thereto.

FIG. 16 is a perspective view of the support structure 102 of the human stabilization platform 100 of FIG. 1 with a modular attachment 196 secured thereto. The selectable attachment structures 180 (see FIGS. 11, 12) may be configured to receive modular accessories 196 to be secured to the human stabilization platform 100 (see FIGS. 1-3). Modular accessories 196 suitable for selective attachment to the selectable attachment structures may include, for example, a transport handle 162, a vibration-damping foot 140 configured to rest on an underlying surface, a medical supply and monitoring equipment attachment system 198 (e.g., a fluid management system) configured to suspend a bag therefrom, additional restraints (e.g., restraints similar to those described in connection with FIGS. 1-3) and another medical supply and monitoring equipment attachment system 200 (see FIG. 17) (e.g., a Special Medical Emergency Evacuation Device (SMEED) that can be used to secure monitors, infusion pumps, ventilators, oxygen cylinders and other medical equipment to the human stabilization platform 100) sized and shaped to extend from one associated selectable attachment structure 180 (see FIGS. 11, 12) on one lateral side of the support structure 102, over the support structure 102, to another associated selectable attachment structure 180 (see FIGS. 11, 12) on an opposite lateral side of the support structure 102.

Figure 17:
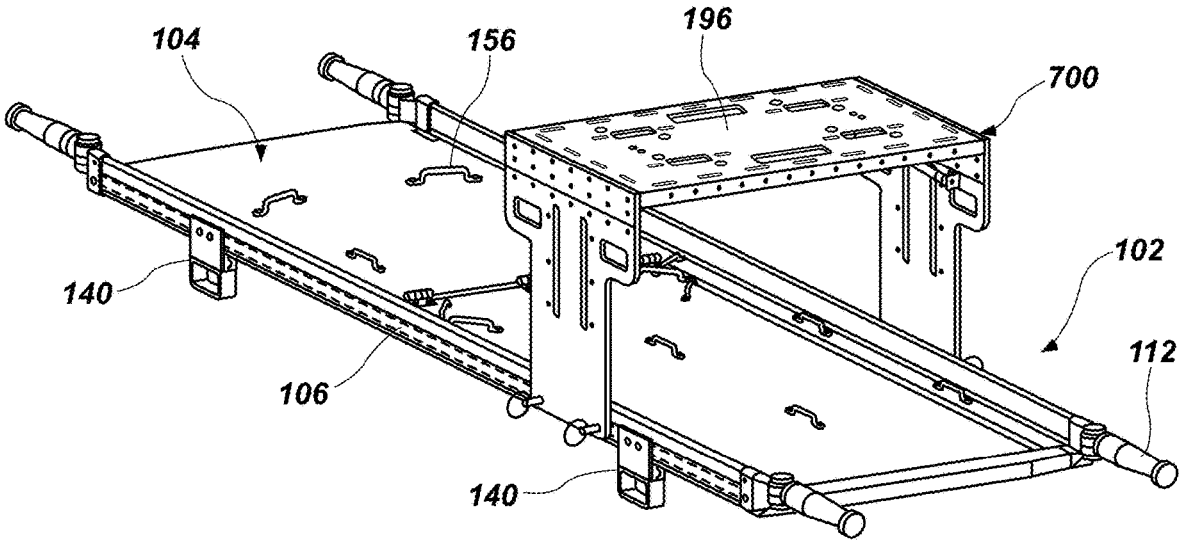
FIG. 17 is a perspective view of the support structure of the human stabilization platform of FIG. 1 with another embodiment of a modular attachment secured thereto.

FIG. 17 is a perspective view of the support structure 102 of the human stabilization platform 100 of FIG. 1 with another embodiment of a modular attachment 196 secured thereto. The modular attachment 196 may be configured as a medical supply and monitoring equipment attachment system 200 sized and shaped to extend from one associated selectable attachment structure 180 (see FIGS. 11, 12) on one lateral side of the support structure 102, over the support structure 102, to another associated selectable attachment structure 180 (see FIGS. 11, 12) on an opposite lateral side of the support structure 102.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A human stabilization platform, comprising:

a support structure configured to rigidly support a person; and a rail extending longitudinally from proximate a portion of the support structure configured to receive the person's head thereon to proximate a portion of the support structure configured to receive the person's lower legs thereon on each lateral side of the support structure, each rail comprising selectable attachment structures distributed along at least a portion of the longitudinal length of the rail, the selectable attachment structures being configured to receive modular accessories to be secured to the human stabilization platform, the selectable attachment structures comprising a channel comprising alternating enlarged sections and constricted sections.

2. The human stabilization platform of claim 1, further comprising a handle at each end of each rail, each handle being rotatable laterally outward beyond the rail to enable manual handling and transport of the human stabilization platform and laterally inward beyond the rail to enable stowage of the respective handle.

3. The human stabilization platform of claim 2, wherein an axis of rotation about which each handle is configured to rotate extends in a direction at least substantially perpendicular to a major plane of the support structure.

4. The human stabilization platform of claim 1, wherein the selectable attachment structures comprise a series of holes extending through at least portions of the rails.

5. The human stabilization platform of claim 1, further comprising a modular accessory comprising a corresponding attachment structure configured to attach to one or more of the selectable attachment structures of the rail, the corresponding attachment structure comprising at least one protrusion comprising an enlarged head sized and shaped to pass through one of the enlarged sections into the channel when the at least one protrusion is aligned with the one of the enlarged sections and to be obstructed from exiting the channel by one of the constricted sections of the channel when the at least one protrusion is aligned with the one of the constricted sections.

6. The human stabilization platform of claim 5, wherein the selectable attachment structures comprise a series of holes, loops, hooks, ledges, or threaded holes extending along at least portions of the rails, wherein the at least one protrusion comprises a pin, hooks, loops, clamps, or threaded members sized, shaped, and configured to mate with corresponding holes, loops, hooks, ledges, or threaded holes of the selectable attachment structures to secure the modular accessory in place.

7. The human stabilization platform of claim 5, wherein the corresponding attachment structure of the modular accessory comprises a pair of protrusions, each protrusion comprising an enlarged head, and wherein the pair of protrusions is spaced to enable the pair to pass through a corresponding pair of the enlarged sections into the channel when the pair of protrusions is aligned with the corresponding pair of the enlarged sections and to be obstructed from exiting the channel by a corresponding pair of the constricted sections of the channel when the pair of protrusions is aligned with the pair of the constricted sections.

8. The human stabilization platform of claim 1, further comprising a modular accessory comprising a corresponding attachment structure configured to attach to one or more of the selectable attachment structures of the rail, the modular accessory selected from the group consisting of a handle, a vibration-damping foot configured to rest on an underlying surface, a restraint, and a medical supply and equipment attachment system sized and shaped to extend from one associated selectable attachment structure on one lateral side of the support structure, over the support structure, to another associated selectable attachment structure on an opposite lateral side of the support structure.

9. The human stabilization platform of claim 1, wherein the support structure comprises a honeycomb core and a surrounding fiber-matrix composite material.

10. The human stabilization platform of claim 1, wherein a stiffness of the support structure is such that the support structure deflects by 1.5 inches or less when subjected to 8 g of acceleration.

11. The human stabilization platform of claim 1, further comprising a five-point harness secured to the support structure and positioned to secure a person to the human stabilization platform.

12. The human stabilization platform of claim 1, further comprising vibration-damping feet extending from the support structure, each vibration-damping foot comprising an elastomeric damping material, each vibration-damping foot comprising a slot extending therethrough to facilitate attachment of the human stabilization platform to a securing structure.

13. The human stabilization platform of claim 1, further comprising a gatch located to receive a person's head and back thereon, the gatch comprising a rotatably liftable backrest and an adjustable lifting mechanism, the adjustable lifting mechanism secured to the backrest and to the support structure, the adjustable lifting mechanism being selectably extendable, retractable and securable in position to enable the backrest to rotate relative to the support structure to raise and lower the torso of a person supported on the support structure and be secured in place at an acute angle to a major plane of the support structure.

14. The human stabilization platform of claim 1, further comprising a mattress secured to, and supported on, the support structure, the mattress comprising a material configured to maintain peak pressure on a person's body at about 65 mm Hg or less.

15. The human stabilization platform of claim 1, wherein a total weight of the human stabilization platform is about 60 lbs or less.

16. A method of making a human stabilization platform, comprising:

sizing, shaping, and configuring a support structure configured to substantially rigidly support a person; and positioning a rail to extend longitudinally from proximate a portion of the support structure configured to receive the person's head thereon to proximate a portion of the support structure configured to receive a person's lower legs thereon on each lateral side of the support structure, each rail comprising selectable attachment structures distributed along at least a portion of the longitudinal length of the rail, the selectable attachment structures being configured to receive modular accessories to be secured to the human stabilization platform, the selectable attachment structures comprising a channel comprising alternating enlarged sections and constricted sections.

17. The method of claim 16, further comprising positioning a handle at each end of each rail, each handle being rotatable laterally outward and laterally inward beyond the rail, each handle being configured to enable manual handling, transport, and stowage of the human stabilization platform.

18. The method of claim 16, further comprising attaching a modular accessory comprising a corresponding attachment structure configured to one or more of the selectable attachment structures of the rail, the corresponding attachment structure comprising at least one protrusion comprising an enlarged head sized and shaped to pass through one of the enlarged sections into the channel when the at least one protrusion is aligned with the one of the enlarged sections and to be obstructed from exiting the channel by one of the constricted sections of the channel when the at least one protrusion is aligned with the one of the constricted sections.

19. The method of claim 18, wherein the selectable attachment structures comprise a series of holes, loops, hooks, ledges, or threaded holes extending along at least portions of the rails, wherein the at least one protrusion comprises a pin, hooks, loops, clamps, or threaded members, and further comprising mating the pin, hooks, loops, clamps, or threaded members with one or more of the corresponding holes, loops, hooks, ledges, or threaded holes to secure the modular accessory in place.

20. A method of using a human stabilization platform, comprising:

rigidly supporting a person on a support structure; and securing a modular accessory to a selectable attachment structure, the selectable attachment structure being selected from a set of selectable attachment structures distributed along at least a portion of a longitudinal length of at least one of a pair of rails, the selectable attachment structures comprising a channel comprising alternating enlarged sections and constricted sections, each rail extending longitudinally from proximate a portion of the support structure on which the person's head is located to proximate a portion of the support structure on which the person's lower legs are located on a respective lateral side of the support structure.

* * * * *